United States Patent [19]

Kubicki et al.

[11] Patent Number: 4,712,463

[45] Date of Patent: Dec. 15, 1987

[54] BRIDGE AND TUNING MECHANISM FOR STRINGED INSTRUMENTS

[76] Inventors: Philip Kubicki; Geoffrey Richardson, both of P.O. Box 40110, Santa Barbara, Calif. 93103

[21] Appl. No.: 831,868

[22] Filed: Feb. 24, 1986

[51] Int. Cl.[4] ..... G10D 3/14

[52] U.S. Cl. ..... 84/304; 84/267; 84/299; 84/313

[58] Field of Search ..... 84/267, 298–299, 84/304–307, 313

[56] References Cited

U.S. PATENT DOCUMENTS

| | | | |
|---|---|---|---|
| 361,500 | 4/1887 | Gardner | 84/306 |
| 521,286 | 6/1894 | Heredia | 84/305 |
| 575,071 | 1/1897 | Simon | 84/306 |
| 3,251,257 | 5/1966 | Bunker | 84/267 |
| 4,608,904 | 9/1986 | Steinberger | 84/304 |
| 4,638,711 | 1/1987 | Stroh | 84/313 |

*Primary Examiner*—Lawrence R. Franklin

*Attorney, Agent, or Firm*—Julian Caplan

[57] ABSTRACT

Located on the body as distinguished from the headstock of an instrument such as a guitar is a combined bridge, string lock and fine tuner. The upper end of each string is attached to the headstock. The lower end is fixed to a ratchet thumbwheel rotatable on a transverse axle mounted in a body fixed to the instrument. By turning the ratchet wheel a rough adjustment of string tension is made. A fine tuning knob controls the pawl of the ratchet for precise turning of the ratchet wheel. A slide is longitudinally adjustable in a groove in the upper end of the body. A screw is threaded into the slider and formed with a slot for the string. The screw stops the vibrating length of string.

9 Claims, 5 Drawing Figures

BRIDGE AND TUNING MECHANISM FOR STRINGED INSTRUMENTS

BACKGROUND OF THE INVENTION

1. Field of the Invention

This invention relates to a new and improved bridge and tuning mechanism for stringed instruments. A preferred embodiment of the invention is in adjusting the height and intonation of strings of a bass guitar and for individual tuning, both rough and fine, of the individual strings of such an instrument.

2. Description of Related Art

Traditionally, tuning mechanisms are located on the headstock of bass guitars and the like. More recently, tuning apparatus has been located on the body of the instrument. However, in such instruments the tuning knobs are difficult to reach in a playing position because of their location. Further, they are difficult to turn due to friction of moving parts against fixed counterparts. Furthermore, tuning is awkward because of the position the hand and wrist must assume in order to manipulate the tuning knobs.

Another disadvantage of prior body-mounted tuning apparatus is the fact that standard strings such as are available in music instrument stores may not be used unless additional tools are used to affix them at the opposite end of the instrument. This is particularly disadvantageous if a string needs to be changed during a performance. Additionally, the special strings for body mounted tuners generally have balls on each end and are restricted as to available lengths as well as gauges and manufacturing processes.

Prior tuners are attached by screws from the face of the body, the effect of which limits contact of the strings with the body and thus reduces sound transmittance of the strings through the body. Accordingly, resonance and tonal characteristics of the instrument are adversely affected.

Prior instruments also use adjustable saddles and vibration stops which determine the maximum (unstopped) length of the strings. However, the saddle and stop hereinafter described has considerable advantage in facility of use as compared with previously used devices.

SUMMARY OF THE INVENTION

Another feature of the invention is that it provides means for comfortably tuning the strings in a playing position with greater accuracy and with less effort.

Another feature of the invention is the provision of improved means for transferring string vibrations to the body of the instrument.

In accordance with the present invention a bridge is provided which has means adjustable up and down for height adjustment of the strings relative to the body. Additionally, the bridge has adjustments back and forth for intonation adjustment.

Another feature of the invention is the provision of a thumb wheel to which the lower end of the string is easily attached. The upper end of the string is provided with a ball received in a conventional receptor at the upper end of the headstock.

A still further feature of the invention is provision of a thumb 1 which is used for rough adjustment of the tension on the string by reason of the fact that the thumb wheel functions as a ratchet wheel. To tighten the string, the thumb wheel is turned in one direction, being held in position by a pawl engaging the ratchet teeth. To detach the string, a pawl release is depressed, permitting the thumb wheel to reverse.

Still another feature of the invention is the provision of a fine adjustment knob for each string which cooperates with the pawl to make minute turning adjustments of the thumb wheel and bring the string tension to a required pitch.

Other objects of the present invention will become apparent upon reading the following specification and referring to the accompanying drawings in which similar characters of reference represent corresponding parts in each of the several views.

Figure 1:
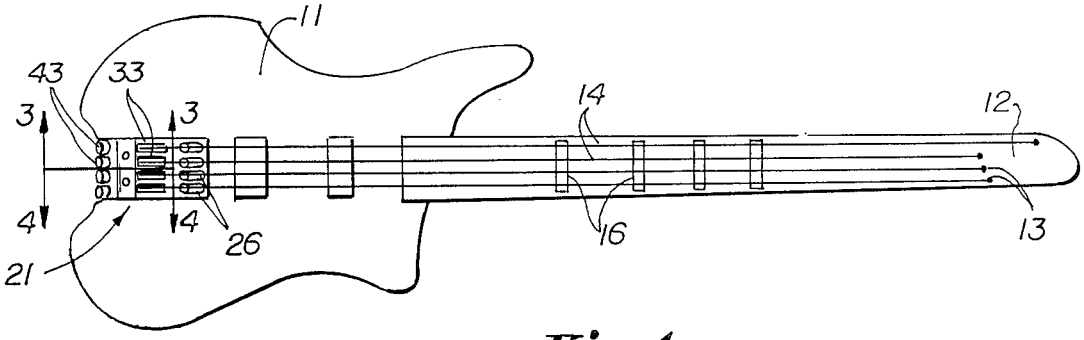
FIG. 1 is a plan view of a guitar in which the present invention is incorporated.
Figure 3:
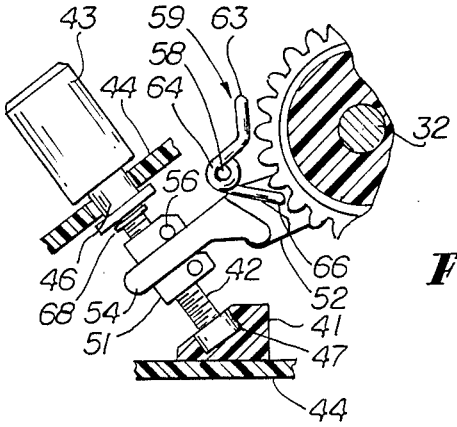
Figure 4:
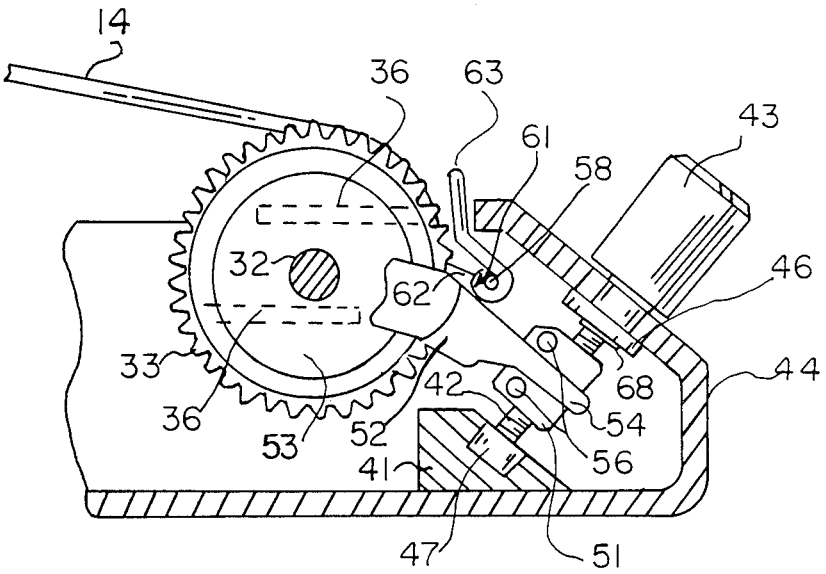

FIGS. 3 and 4 are enlarged fragmentary sectional views taken substantially along the lines 3—3 and 4—4 of FIG. 1.

Figure 2:
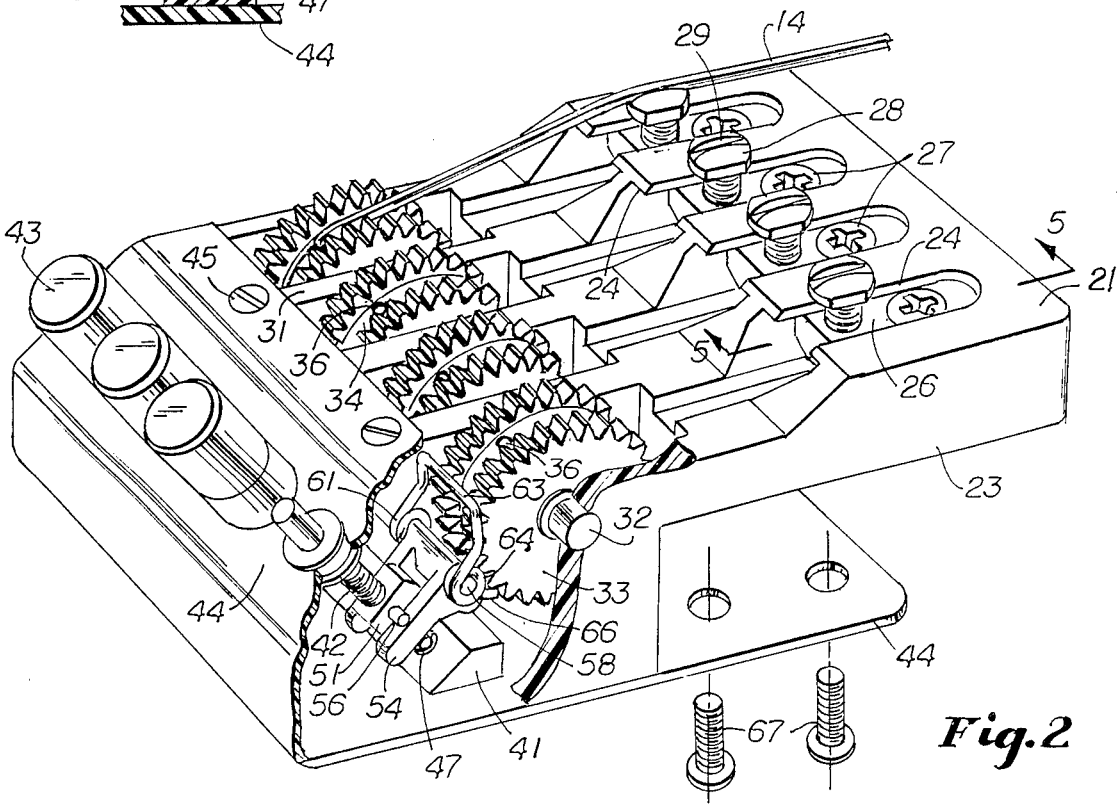
FIG. 2 is an enlarged perspective view of the bridge and string adjustment.
Figure 5:
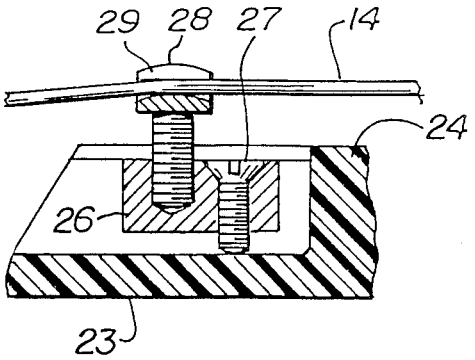

FIG. 5 is still another sectional view taken substantially along the line 5—5 of FIG. 2.

DESCRIPTION OF PREFERRED EMBODIMENTS

The present invention is shown installed on a conventional bass guitar having a body 11 and a headstock 12. It will be understood that the invention has application to other stringed instruments. At the upper end of headstock 12 are holders 13 which receive the balls (not shown) on the upper ends of strings 14. Frets 16 are illustrated schematically in FIG. 1 and are used in normal fashion.

Tuner 21 is located on the lower end of body 11. It consists of a cover plate 44 which is attached by means of screws 67 to the body 11. Upper extension 23 on the upper face of body 11 is formed with dovetail channels 24, one channel for each string 14. Each channel 24 has a slider 26 which is held in a position of adjustment by a lock screw 27. The head of screw 27 bears against the roof of channel 24 and by turning the same, the slider 26 is forced downwardly against the bottom of the channel 24, locking the slider in place. Threaded into slider 26 is a screw 28 having a curved slot 29 which receives string 14. Adjustment of screw 28 determines the height of string 14 above body 11. Screw 28 functions as a stop, limiting the length of vibration of string 14. Such length may be adjusted by moving the slider backward or forward in the channel 24 and then locking the same in position with screw 27. To either side of and downwardly relative to channels 24 are partitions 31. Extending transversely through partitions 31 is an axle 32 on which is mounted for rotation a toothed wheel 33, one wheel 33 for each string 14. The string is received in groove 34 which divides the periphery of wheel 33 into two parts. A hole 36 is formed in one of the parts of wheel 33 and the end of string 14 is threaded into the hole 34. When the wheel 33 is turned, the edge of hole 36 grips the string 14 and further turning of wheel 33 tightens the string.

Mounted on cover plate 44 is a retainer block 41 which receives the lower end of screw 42. The upper end of screw 42 is fixed to a knob 43 on the outside of cover plate 44 which closes off the lower end of tuner 21 and is secured by screws 45 threaded into the lower ends of partitions 31. Fixed to screw 42 is an E-ring 68 on the under side of bearing 46 mounted in cover plate 44. On the lower end of screw 42 is a retainer 47 inside retainer block 41. Accordingly, as knob 43 is turned, the screw 42 is turned, but there is no longitudinal movement of the screw 42 relative to the retainer block 41.

Threaded onto screw 42 is a square nut 51. Since, as hereinafter appears, nut 51 cannot turn, it moves longitudinally relative to the screw 42 when the knob 43 is turned. Fitting 52 is of irregular shape. It has a forward extending center portion 53 apertured for passage of axle 32. At its rearward or lower end it is formed as a clevis 54, and the nut 51 fits between the arms of clevis 54 thereby preventing the nut 51 from turning. Roll pins 56 pass through nut 51 on the top and bottom of each arm of clevis 54. Hence, as the nut 51 moves longitudinally of the screw 42, the fitting 52 pivots clockwise or counterclockwise about the axle 32. Extending out to either side of clevis 54 are bosses 58.

Spring 59 has a first coil which fite around one of the bosses 58. The free end of first coil 61 bears against the fitting 52. The opposite end of coil 61 connects to a transverse release 63, the opposite end of which is connected to second coil 64 which fits around the other boss 58. The free end of second coil 64 comprises pawl 66 which engages the teeth in wheel 33, the wheel 33 functioning as a ratchet.

Thus, for rough adjustment of the tension of string 14, the musician turns wheel 33 with the thumb, causing the string 14 to be tightened in that its lower end is fixed within the hole 36. Pawl 66 engages one of the teeth in wheel 33 to prevent reverse motion thereof. If it is desired to release the wheel 33, the operator depresses the transverse release 63, disengaging the pawl 66 from the teeth of wheel 33.

Fine adjustment is made by turning knob 43 which causes the nut 51 to move up or down on the screw 42. Such movement causes oscillation of fitting 52 on axle 32. As the fitting 52 turns, the force of pawl 66 against wheel 33 results in fine adjustment of the tension of string 14.

What is claimed is:

1. In an instrument having at least one string, a bridge comprising a frame an axle in said frame transverse to said string, a wheel rotatable on said axle and held against axial movement along said axle, first means securing said string to said wheel, said wheel having toothed second means whereby the user may rotate said wheel in one direction to tighten said string, third means engaging said second means to secure said wheel against return rotation, fourth means to render said third means inoperative, a knob, fifth means to convert turning of said knob to movement of said third means for very short angular movement of said wheel, a slider adjustably movable in said frame parallel to said string, a stop carried by said slider and sixth means to secure said slider in a position of adjustment, said string being contacted by said stop to limit effective vibrating length of said string.

2. In an instrument having at least one string, a bridge comprising a frame, an axle in said frame transvere to said string, a wheel on said axle, first means securing said string to said wheel, said wheel having second means whereby the user may turn said wheel in one direction to tigten said string, third means to secure said wheel against return rotation, fourth means to render said third means inoperative, a knob, fifth means to convert turning of said knob to very short angular movement of said wheel, a screw mounted for rotation in said frame, said knob being fixed to said screw, a nut movable along said screw, a fitting pivotable about said axle, sixth means for pivoting said fitting as said nut moves, said third and fourth means being mounted on said fitting, said fifth means comprising said fitting, said nut and said screw.

3. A bridge according to claim 1 in which said first means comprises a hole in said wheel through which said string passes, the margin of said hole gripping said string.

4. A bridge according to claim 1 in which seoond means comprises serrations on the periphery of said wheel.

5. A bridge according to claim 4 in which said third means comprises a pawl engaging said serrations.

6. A bridge according to claim 2 which further comprises a spring having aligned first and second coils pivotably mounted on said fitting, a release stretch interconnecting said coils, and a pawl extending from one said coil, said wheel having peripheral serrations engageable with said pawl, said pawl comprising said third means, said release stretch when manually engaged causing said pawl to disengage from said serrations to comprise said fourth means.

7. A bridge according to claim 6 in which said wheel is formed with a circumferential groove dividing said serrations in two, said string fitting in said groove, said wheel formed with a hole parallel to said axis communicating with said groove, the margin of said hole gripping said string and comprising said first means.

8. A bridge according to claim 2 in which said fitting is formed in a clevis, said nut being received in said clevis and fixed so that movement of said nut along said screw causes movement of said clevis about said axis.

9. In an instrument having at least one string, a bridge comprising a frame, an axle in said frame transverse to said string, a wheel on said axle, first means securing said string to said wheel, said wheel having second means whereby the user may turn said wheel in one direction to tighten said string, third means to secure said wheel against return rotation, fourth means to render said third means inoperative, a knob, and fifth means to convert turning of said knob to very short angular movement of said wheel, said second means comprising serrations on the periphery of said wheel, said third means comprising a pawl engaging said serrations and in which said fifth means moves said pawl to turn said wheel.

* * * * *